US010815994B2

(12) United States Patent
Lee et al.

(10) Patent No.: US 10,815,994 B2
(45) Date of Patent: Oct. 27, 2020

(54) MUTUAL ROTATING SCROLL COMPRESSOR

(71) Applicant: LG ELECTRONICS INC., Seoul (KR)

(72) Inventors: Jaesang Lee, Seoul (KR); Jinho Kim, Seoul (KR); Sanghun Seong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 267 days.

(21) Appl. No.: 15/912,215

(22) Filed: Mar. 5, 2018

(65) Prior Publication Data

US 2018/0252216 A1 Sep. 6, 2018

(30) Foreign Application Priority Data

Mar. 6, 2017 (KR) ..... 10-2017-0028438

(51) Int. Cl.
*F03C 2/00* (2006.01)
*F03C 4/00* (2006.01)
(Continued)

(52) U.S. Cl.
CPC ..... *F04C 18/0253* (2013.01); *F04C 18/023* (2013.01); *F04C 29/0057* (2013.01);
(Continued)

(58) Field of Classification Search
CPC .. F04C 18/023; F04C 18/0253; F04C 23/008; F04C 27/001; F04C 29/0057;
(Continued)

(56) References Cited

U.S. PATENT DOCUMENTS 4,846,639 A * 7/1989 Morishita ..... F04C 18/023 418/55.5
5,129,798 A * 7/1992 Crum ..... F04C 18/023 418/55.5
(Continued)

FOREIGN PATENT DOCUMENTS

EP 0478795 A1 4/1992
EP 1 719 912 A2 11/2006
(Continued)

*Primary Examiner* — Theresa Trieu
(74) *Attorney, Agent, or Firm* — Birch, Stewart, Kolasch & Birch, LLP

(57) ABSTRACT

A mutual rotating scroll compressor includes: a first frame fixed to a casing; a second frame provided with an interval between the first frame and the second frame, a compression space being provided between the first frame and the second frame; a first scroll rotatably supported by the first frame and coupled to a driving motor to rotate in the compression space; a second scroll engaged with the first scroll to rotate about the second frame, the second scroll and the first scroll forming a compression chamber in the compression space; and a bearing housing including a housing part, including a boss accommodation part to which the second scroll is rotatably coupled, and a hinge lug which extends from the housing part and is movably coupled to the second frame.

19 Claims, 13 Drawing Sheets

(51) Int. Cl.

| | |
|---|---|
| ***F04C 18/00*** | (2006.01) |
| ***F04C 2/00*** | (2006.01) |
| ***F04C 18/02*** | (2006.01) |
| ***F04C 29/02*** | (2006.01) |
| ***F04C 29/12*** | (2006.01) |
| ***F04C 29/00*** | (2006.01) |
| *F04C 23/00* | (2006.01) |
| *F04C 27/00* | (2006.01) |

(52) U.S. Cl.
CPC ..... *F04C 29/023* (2013.01); *F04C 29/026* (2013.01); *F04C 29/12* (2013.01); *F04C 23/008* (2013.01); *F04C 27/001* (2013.01); *F04C 2240/20* (2013.01); *F04C 2240/30* (2013.01); *F04C 2240/50* (2013.01); *F04C 2240/56* (2013.01)

(58) Field of Classification Search
CPC ..... F04C 29/023; F04C 29/026; F04C 29/12; F04C 2240/20; F04C 2240/30; F04C 2240/50; F04C 2240/56
USPC ..... 418/55.1–22.6, 57, 60, 55.1–55.6, 270
See application file for complete search history.

(56) References Cited

U.S. PATENT DOCUMENTS

| | | | | | |
|---|---|---|---|---|---|
| 5,242,282 | A | * | 9/1993 | Mitsunaga ..... | F04C 18/023 418/55.5 |
| 5,713,731 | A | * | 2/1998 | Utter ..... | F04C 18/023 418/55.5 |
| 5,803,722 | A | | 9/1998 | Noboru et al. | |

FOREIGN PATENT DOCUMENTS

| | | | |
|---|---|---|---|
| JP | 5-296166 | A | 11/1993 |
| JP | 6-3192 | B2 | 1/1994 |
| JP | 7-259760 | A | 10/1995 |
| JP | 7-293473 | A | 11/1995 |
| JP | 7-332260 | A | 12/1995 |
| JP | 8-35492 | A | 2/1996 |
| KR | 10-1992-0010734 | B1 | 12/1992 |
| KR | 10-2018-0031986 | A | 3/2018 |

* cited by examiner

MUTUAL ROTATING SCROLL COMPRESSOR

CROSS-REFERENCE TO RELATED APPLICATION

Pursuant to 35 U.S.C. § 119(a), this application claims the benefit of earlier filing date and right of priority to Korean Application No. 10-2017-0028438, filed on Mar. 6, 2017, the contents of which is incorporated by reference herein in its entirety.

BACKGROUND OF THE DISCLOSURE

1. Field of the Disclosure

The present disclosure relates to a scroll compressor, and more particularly, to a scroll compressor in which two scrolls rotate mutually (i.e. a co-rotating scroll compressor).

2. Background of the Disclosure

Generally, in scroll compressors, two scrolls are engaged with and coupled to each other, and the two scrolls perform a turning movement in engagement with each other to form a compression chamber.

The compression chamber is formed by wraps of the two scrolls and has a volume which is reduced in a direction from an outer side to a center of each of the wraps. Therefore, fluid flows in from the outer side of the wrap and is discharged in a state which is compressed in a center.

The scroll compressors use a pair of scrolls in terms of the compression principle. Conventional scroll compressors are swirl scroll compressors in which one scroll is fixed, and another scroll performs a turning (orbiting) movement to compress fluid without rotating.

In the swirl scroll compressors, a swirl scroll should turn (orbit) with respect to a fixed scroll without rotating, but due to the principle thereof, a center of gravity of the swirl scroll is eccentric from a center of a turn, whereby as a rotational speed increases, a centrifugal force proportional to the square of velocity acts thereon. For this reason, since vibration increases, the swirl scroll compressors have a structure unsuitable for high speed driving.

On the other hand, mutual rotating scroll compressors have a structure where a driving scroll and a driven scroll rotate in the same direction and rotate about a center of rotation thereof where rotational shafts are differently located, but do not perform a turning movement. Therefore, the problem of a centrifugal force occurring in the swirl scroll compressors due to the principle does not occur in the mutual rotating scroll compressors, and thus, the mutual rotating scroll compressors have a structure suitable for high speed driving.

As an example of the mutual rotating scroll compressors, a rotating scroll compressor has been disclosed in EP1719912 (U.S. Pat. No. 5,803,722).

In a related art mutual rotating scroll compressor, since a driving scroll and a driven scroll do not mutually rotate, a centrifugal force does not occur. For this reason, the related art mutual rotating scroll compressor is better than the swirl scroll compressors in terms of vibration, but is worse than the swirl scroll compressors in terms of sealing of a compression chamber.

Generally, in scroll compressors, as refrigerants are compressed, a gas repulsion occurs, and a gap between wraps configuring the compression chamber is widened by the gas repulsion, whereby compression chambers adjacent to each other in a circumference direction may communicate with each other. For this reason, radius-direction leakage where some of refrigerants compressed in a compression chamber having a relatively high pressure are leaked to a compression chamber having a relatively low pressure can occur. Therefore, the swirl scroll compressors are slightly unfavorable in terms of vibration, but since the swirl scroll is closely adhered to the fixed scroll by a centrifugal force, a sealing force of the compression chamber is maintained.

On the other hand, the mutual rotating scroll compressors, as in FIG. 1, a driving scroll 1 rotates about a boss part 1*a* configuring a rotational center O1 thereof, and a driven scroll 2 rotates about a boss part 2*a* configuring a rotational center O2 thereof. Therefore, a constant eccentric distance ε between the rotational center O1 of the driving scroll and the rotational center O2 of the driven scroll is maintained, and thus, a centrifugal force does not act between the two scrolls 1 and 2. Therefore, the unbalance of a force acting in a radius direction of each of the two scrolls 1 and 2 is attenuated, and thus, a vibration of a compressor can be considerably reduced in comparison with the swirl scroll compressors. However, since a gas repulsion occurring when refrigerants are compressed in a compression chamber is not removed, a gap between a wrap 1*b* of the driving scroll 1 and a wrap 2*b* of the driven scroll 2 is widened, and for this reason, refrigerants of a high-pressure compression chamber is not prevented from being leaked in a radius direction toward a low-pressure compression chamber, causing a reduction in compressor efficiency.

Moreover, in the related art mutual rotating scroll compressor, since the driving scroll 1 rotates about the boss part 1*a* corresponding to the rotational center O1 thereof and the driven scroll 2 rotates about the boss part 2*a* corresponding to the rotational center O2 thereof, it is structurally difficult to support both ends of each of the driving scroll 1 and the driven scroll 2. Therefore, in the related art, a method has been proposed where a back pressure plate 3 is disposed on a rear surface of the driven scroll 2 engaged with the driving scroll 1, the back pressure plate 3 is coupled to the driving scroll 1, and both ends of the driving scroll 1 are supported by supporting the back pressure plate 3 in a radius direction.

However, in the related art mutual rotating scroll compressor, a configuration for supporting the driving scroll 1 is complicated. That is, as illustrated in FIGS. 1 and 2, an eccentric bush 5 is inserted into and fixedly coupled to a sub-frame 4, and the back pressure plate 3 is inserted onto and rotatably coupled to an outer circumference surface of the sub-frame 4. Therefore, the number of elements and the number of assembly processes based thereon increase, and the material cost and the manufacturing cost increase.

Moreover, in the related art mutual rotating scroll compressor, a width of a bearing part in the radius direction increases by an increase in number of elements for supporting both ends of the driving scroll 1, and thus, a frictional surface with a bearing surface B between the back pressure plate 3 and the sub-frame 4 is enlarged, causing a reduction in compressor efficiency due to frictional loss.

Moreover, in the related art mutual rotating scroll compressor, if a width of a driven-side bearing part in the radius direction increases, an internal diameter B of the back pressure plate increases, and for this reason, a space for configuring a back pressure chamber on a rear surface of the driven scroll 2 is relatively reduced. Therefore, a degree of design freedom of the back pressure chamber is lowered, and moreover, an internal diameter of a back pressure member 6 for the back pressure chamber increases. For this reason, an area of the back pressure member 6 is enlarged, and thus, frictional loss increases.

Moreover, in the related art mutual rotating scroll compressor, a rotational force of the driving scroll 1 is not normally transferred to the driven scroll 2, and thus, like the swirl scroll compressors, a separate anti-rotating mechanism is installed in the driven scroll 2. However, the anti-rotating mechanism is installed between the driving scroll 1 and the driven scroll 2 and plugs a suction flow path for refrigerants, and for this reason, suction loss occurs or a size of the compressor increases for securing the suction flow path.

Moreover, in the related art mutual rotating scroll compressor, refrigerants compressed in a compression part are discharged into an internal space of a casing 7 through a discharging hole 2*c* included in the boss part 2*a* of the driven scroll 2, but oil mixed with the refrigerants is discharged to the outside of the compressor along with the discharged refrigerants, whereby oil is insufficient in the compressor. Therefore, in the related art, an oil separation plate (not shown) may be installed on a boss part 2*c*, but since the oil separation plate is separately installed, the manufacturing cost increase.

SUMMARY OF THE DISCLOSURE

Therefore, an aspect of the detailed description is to provide a mutual rotating scroll compressor in which a configuration for supporting both ends of a driving scroll is simplified, and thus, the manufacturing cost is reduced.

Another is to provide a mutual rotating scroll compressor in which a diameter of a bearing part supporting a driving scroll in a radius direction is reduced, and thus, frictional loss is reduced.

Another is to provide a mutual rotating scroll compressor in which a degree of freedom of a back pressure chamber supporting a rear surface of a driven scroll is secured, and an internal diameter of a sealing member configuring the back pressure chamber is reduced, thereby decreasing frictional loss.

Another is to provide a mutual rotating scroll compressor in which wraps of two scrolls are closely adhered to each other, and thus, refrigerants are prevented from being leaked in a radius direction.

Another is to provide a mutual rotating scroll compressor in which an installation of an anti-rotating mechanism inducting a turning movement between a driving scroll and a driven scroll is simplified, and suction loss is prevented from occurring due to the anti-rotating mechanism, thereby increasing compression efficiency.

Another is to provide a mutual rotating scroll compressor in which oil is easily separated from refrigerants discharged from a compression chamber and is prevented from being leaked to the outside of the compressor.

Another is to provide a mutual rotating scroll compressor in which a driving scroll and a driven scroll rotate mutually, the driven scroll is rotatably coupled to a first member which is eccentric from a rotational center of the driven scroll, and the first member is provided so as to vary a turning radius of the driven scroll with respect to the driving scroll.

Here, the first member may include a hinge lug which is eccentric with respect to a rotational center of the driving scroll.

Moreover, a second member may be coupled to the driving scroll and may be rotatably inserted into an outer circumference surface of the first member, and the second member may configure a back pressure chamber on a rear surface of the driven scroll.

To achieve these and other advantages and in accordance with the purpose of this specification, as embodied and broadly described herein, a mutual rotating scroll compressor includes: a casing; a first frame fixed to the casing; a second frame provided with an interval between the first frame and the second frame, a compression space being provided between the first frame and the second frame; a first scroll rotatably supported by the first frame and coupled to a driving motor to rotate in the compression space; a second scroll engaged with the first scroll to rotate about the second frame, the second scroll and the first scroll forming a compression chamber in the compression space; and a bearing housing including a housing part, including a boss accommodation part to which the second scroll is rotatably coupled, and a hinge lug which extends from the housing part and is movably coupled to the second frame, wherein in the bearing housing, a third center which is a center of the hinge lug in an axial direction is provided on a plane and is eccentric with respect to a second center which is a center of the boss accommodation part in an axial direction, and each of the second center and the third center is provided on a plane and are eccentric with respect to a first center of the first scroll in an axial direction.

Here, when a line connecting the first center to the third center is a first virtual line and a line perpendicularly intersecting the first virtual line and passing by the first center is a second virtual line, the third center may be provided at a position which is spaced apart from each of the first virtual line and the second virtual line by a certain distance on the opposite side of the second center with respect to the second virtual line.

Moreover, the third center may be provided at a position at which a first distance which is a distance between the third center and the first center is shorter than a second distance which is a distance between the third center and the second center.

Here, the first center may be provided to match a center of the housing part.

Moreover, the mutual rotating scroll compressor may further include a back pressure plate coupled to the first scroll to support a rear surface of the second scroll, wherein one end of the back pressure plate in an axial direction may be coupled to the first scroll as one body, another end of the back pressure plate in the axial direction may be rotatably coupled to the bearing housing, and both ends of the first scroll in an axial direction may be supported in a radius direction.

Moreover, a bearing lug, which is inserted into and rotatably coupled to an outer circumference surface of the housing part, may be provided in the other end of the back pressure plate.

Moreover, the back pressure plate may include: a plurality of fame parts coupled to the first scroll; and a plate part coupled to the plurality of frame parts and provided on a rear surface of the second scroll, and an anti-rotating member for preventing a rotating movement of the second scroll is provided between the plate part and the second scroll corresponding thereto.

Moreover, a back pressure chamber supporting the second scroll in a direction toward the first scroll may be provided between the second scroll and the back pressure plate, and the anti-rotating member may be provided in the back pressure chamber.

Moreover, a plurality of sealing members may be provided on one side surface of the back pressure plate and may be arranged at certain intervals in a radius direction, and the back pressure chamber may be provided between adjacent sealing members of the plurality of sealing members.

Here, a boss part receiving a rotational force of the driving motor may be provided in the first scroll, an oil discharging path which communicates with the compression chamber to guide compressed refrigerants to an internal space of the casing may be provided in the boss part, an oil discharging hole sequentially passing through an inner circumference surface of the oil discharging path and an outer circumference surface of the boss part may be provided in a middle portion of the oil discharging path, and an outer end of the oil discharging hole may be located between the first frame and the driving motor.

Moreover, a stepped surface may be provided in the middle portion of the oil discharging path, and the stepped surface may be provided on the opposite side of the compression chamber with respect to the oil discharging hole.

Moreover, the boss part may include a first boss part, provided in the first scroll and supported by the first frame, a rotational shaft coupled to a rotator of the driving motor at one end of the rotational shaft and coupled to the first boss part at another end, a discharging port sequentially passing through the compression chamber and an end of the first boss part may be provided in the first boss part, a discharging hole communicating with the discharging port may be provided between the both ends of the rotational shaft to pass through the both ends of the rotational shaft, and the oil discharging hole and a stepped surface may be provided in the first boss part or the rotational shaft.

Here, the first frame and the second frame may be sealing-coupled to an inner circumference surface of the casing, the compression space may be separated from an internal space of the casing, a suction pipe passing through the casing may be communication-coupled to the compression space, a discharging pipe passing through the casing may be communication-coupled to an internal space of the casing, the internal space of the casing may include a first space provided on the first frame and a second space provided under the second frame, the first space may communicate with the second space, the first frame and the second frame may be coupled to a connection frame, and an oil feed path which guides oil filled into the second space to a sliding part of a corresponding frame may be provided in each of the second frame, the connection frame, and the first frame.

Moreover, a sealing member may be provided in each of the first frame and the second frame so that the compression space is separated from the first space and the second space.

To achieve the objects of the present invention, a mutual rotating scroll compressor includes: a casing; a first frame provided in the casing, a bearing part being provided in the first frame; a second frame provided with an interval between the first frame and the second frame, a hinge groove being provided in the second frame to be eccentric with respect to the bearing part; a first scroll including a first boss part rotatably inserted into the bearing part of the first frame; a second scroll engaged with the first scroll, the second scroll including a second boss part which is eccentric with respect to the first boss part; a bearing housing including a boss accommodation part, into which the second boss part of the second scroll is rotatably inserted, and a hinge lug movably coupled to the hinge grooved of the second frame; and a back pressure plate including a bearing lug one end coupled to the first scroll and another end rotatably inserted into an outer circumference surface of the bearing housing, wherein a first bearing is provided between the bearing part of the first frame and the first boss part of the first scroll, a second bearing is provided between an inner circumference surface of the back pressure plate and an outer circumference surface of the bearing housing, and a third bearing is provided between the second boss part of the second scroll and an inner circumference surface of the boss accommodation part of the bearing housing.

Here, a center of the third bearing may be provided to have an eccentric distance between a center of the first bearing and the center of the third bearing, and when the bearing housing rotates about the hinge lug, the eccentric distance between a center of the first bearing and the center of the third bearing may vary.

Moreover, a wrap forming a compression chamber may be provided in each of the first scroll and the second scroll, and the center of the first bearing and the center of the second bearing may be disposed on concentricity at a time when the wraps contact each other.

Here, a back pressure chamber may be provided in a ring shape between the second scroll and the back pressure plate, and an anti-rotating member for preventing a rotation of the second scroll may be provided within a range of the back pressure chamber.

Moreover, the first boss part may be coupled to a rotational shaft of a driving motor provided in an internal space of the casing, an oil discharging path which guides compressed refrigerants from a compression chamber between the first and second scrolls to the internal space of the casing may be in the first boss part and the rotational shaft, and a through hole communicating with the internal space of the casing may be provided in a middle portion of the oil discharging path.

Moreover, a stepped surface may be provided on an inner circumference surface of the oil discharging path, and the stepped surface may be provided on the opposite side of the first scroll with respect to the through hole.

In a mutual rotating scroll compressor according to the present invention, a bearing housing rotatably supporting a driven scroll may be rotatably coupled to a sub-frame, and a back pressure plate coupled to a driving scroll may be rotatably inserted into the bearing housing, thereby simplifying a configuration for supporting both ends of the driving scroll to reduce the manufacturing cost.

Moreover, a bearing lug supporting the driving scroll in a radius direction may be coupled to the bearing housing, and thus, a diameter of a bearing part supporting the driving scroll in the radius direction is reduced, thereby decreasing frictional loss.

Moreover, since a width of the bearing part is reduced, a degree of freedom of a back pressure chamber supporting a rear surface of a driven scroll is secured, and moreover, an internal diameter of a sealing member forming the back pressure chamber is reduced, thereby decreasing frictional loss.

Moreover, a hinge lug of the bearing housing may be provided so as to be eccentric with respect to a rotational shaft of the driving scroll, a moment may be generated so that wraps of both scrolls are closely adhered to each other, thereby preventing refrigerants from being leaked in the radius direction.

Moreover, an anti-rotating mechanism inducing a turning movement between the driving scroll and the driven scroll may be installed on a rear surface of the driven scroll, and thus, an installation of the anti-rotating mechanism is simplified and suction loss is prevented from being caused by the anti-rotating mechanism, thereby increasing compression efficiency.

Moreover, an oil separation surface may be provided in a middle portion of an oil discharging path, and thus, oil is easily separated from refrigerants discharged from a compression chamber, thereby minimizing the amount of oil leaked to the outside of the compressor.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a mutual rotating scroll compressor according to embodiments of the present invention will be described in detail with reference to the accompanying drawings.

Figure 1:
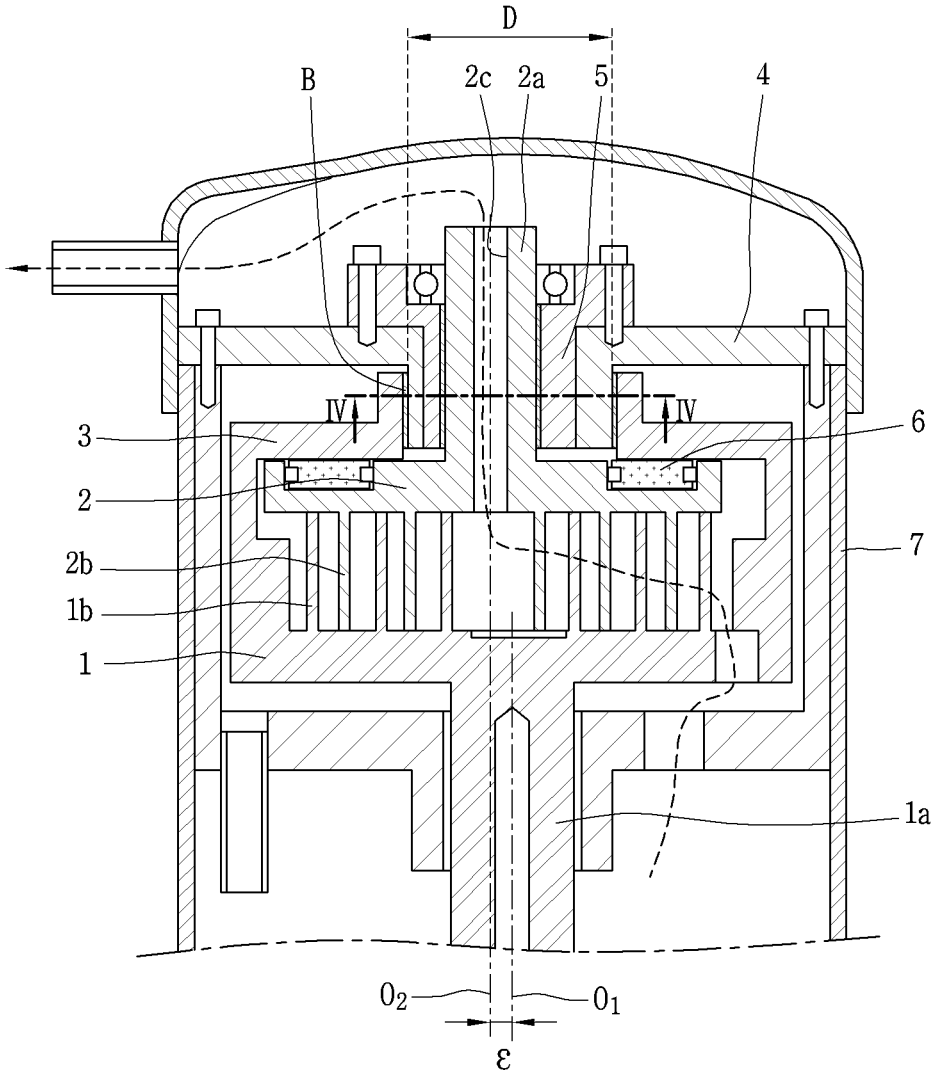
FIG. 1 RELATED ART
FIG. 1 a vertical cross-sectional view illustrating an embodiment of a related art mutual rotating scroll compressor.
Figure 2:
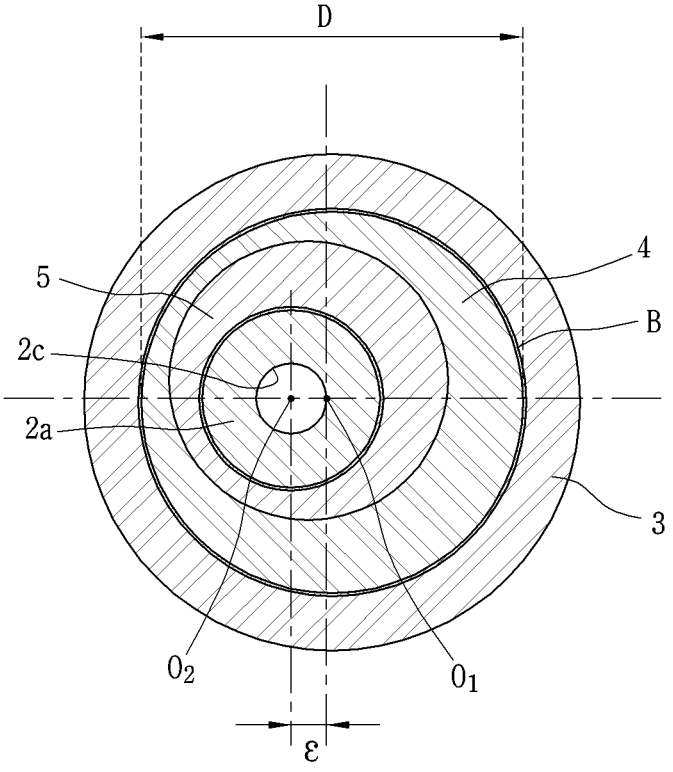
FIG. 2 RELATED ART
FIG. 2 is a cross-sectional view taken along line IV-IV of a bearing part in FIG. 1.
Figure 3:
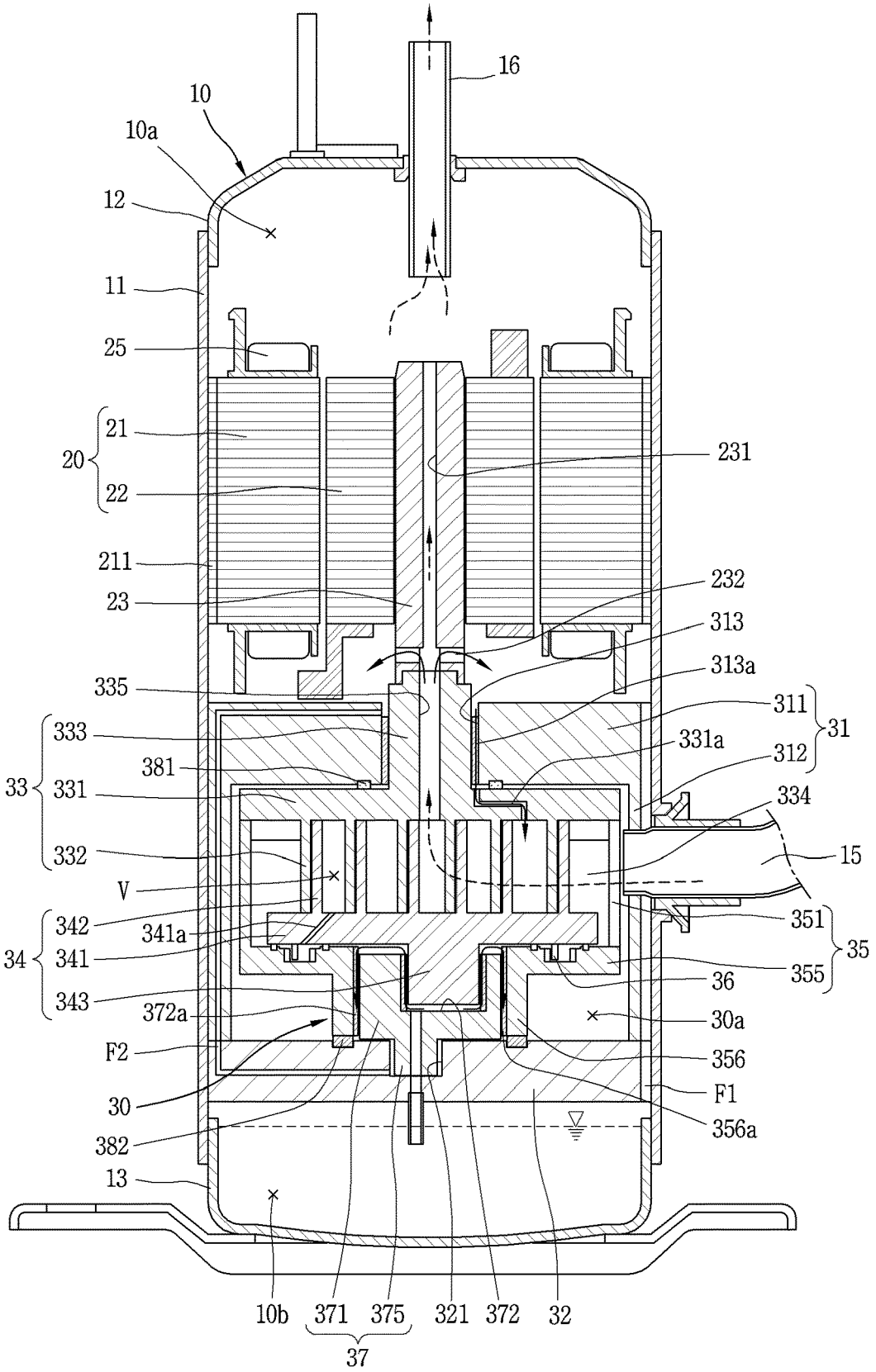
FIG. 3 is a vertical cross-sectional view illustrating an embodiment of a mutual rotating scroll compressor according to the present invention.
Figure 4:
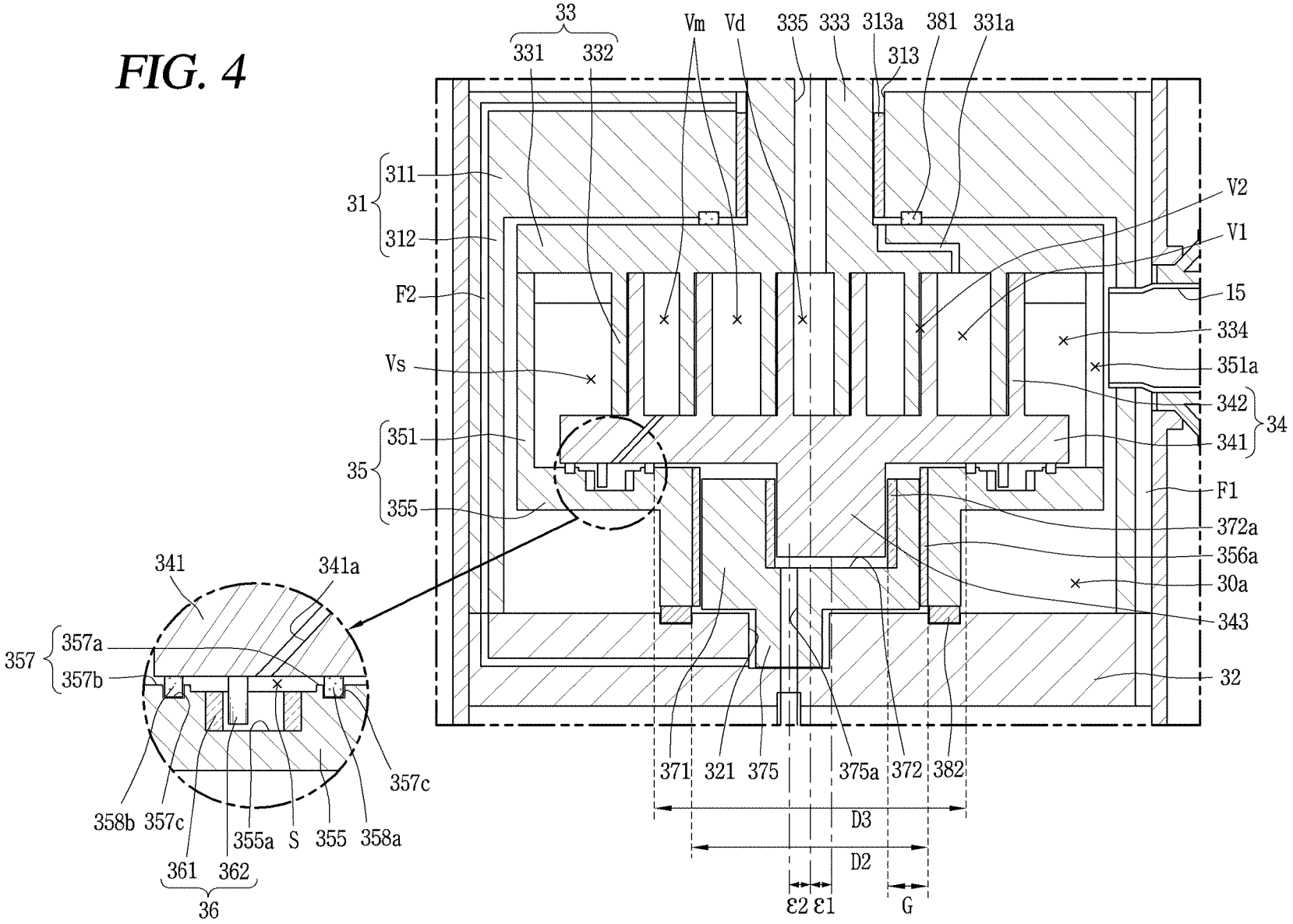
FIG. 4 an enlarged vertical cross-sectional view of a compression unit in FIG. 3.
Figure 5:
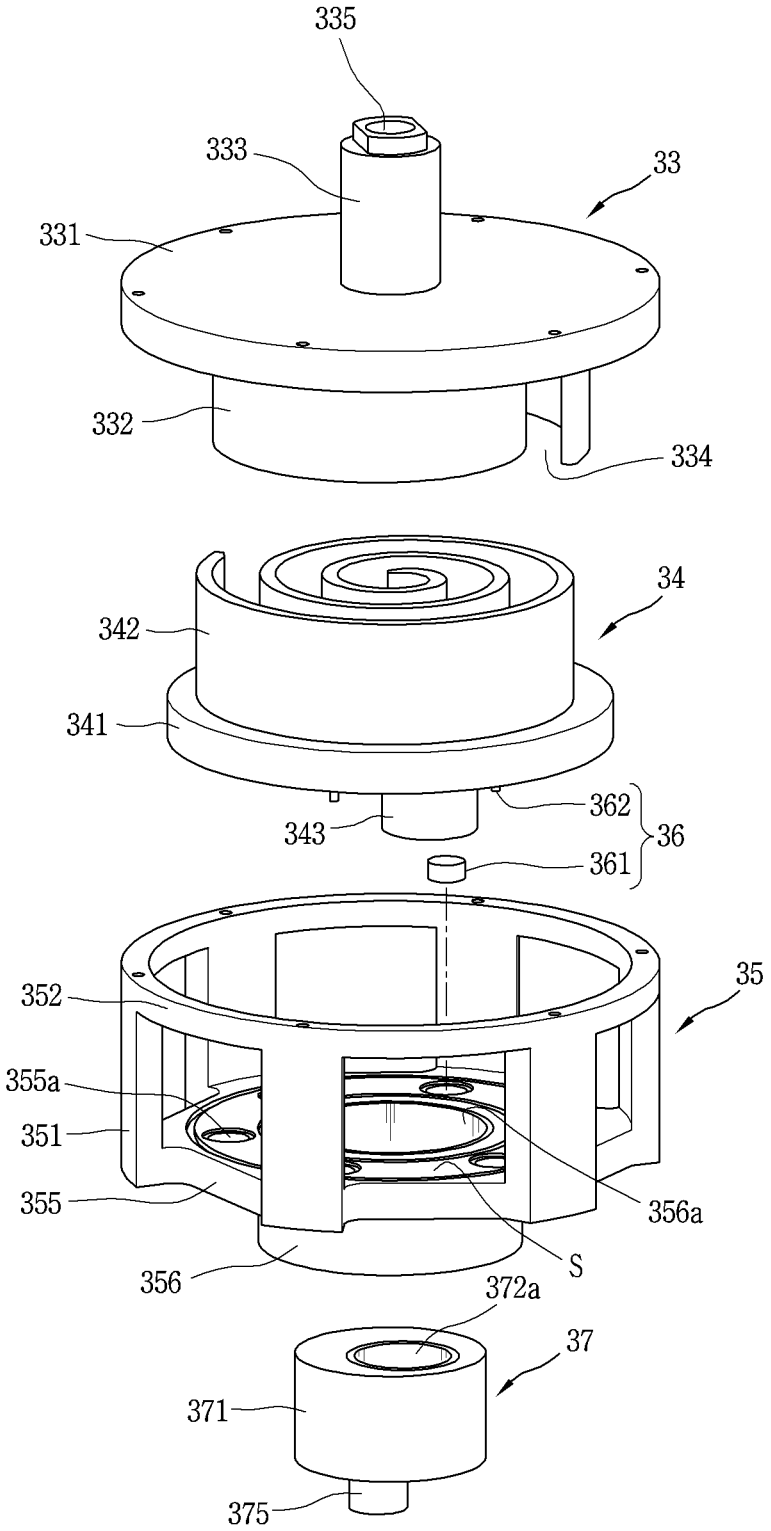
FIGS. 5 and 6 are perspective views illustrating disassembly and assembly of the compression unit in FIG. 3.
Figure 6:
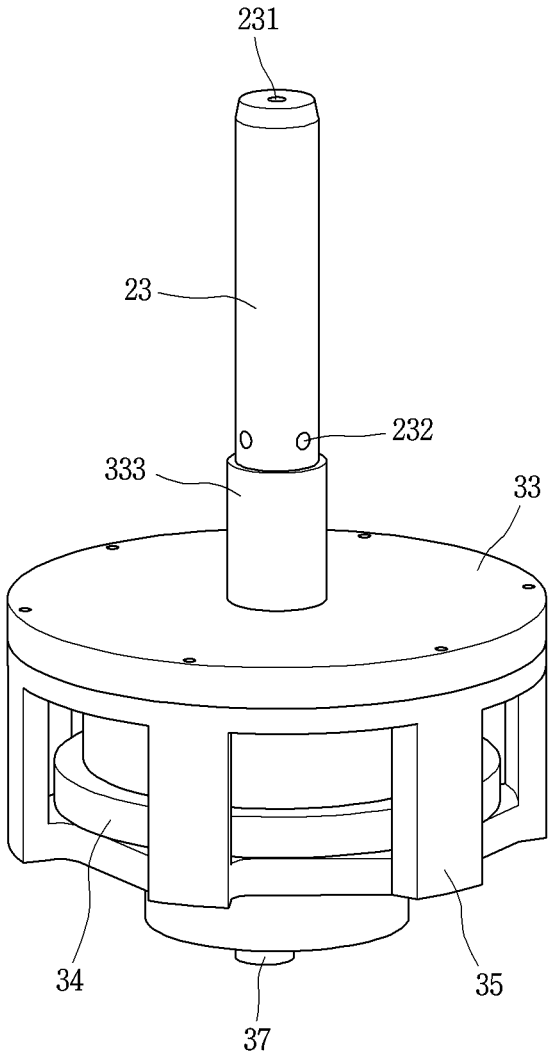
Figure 7:
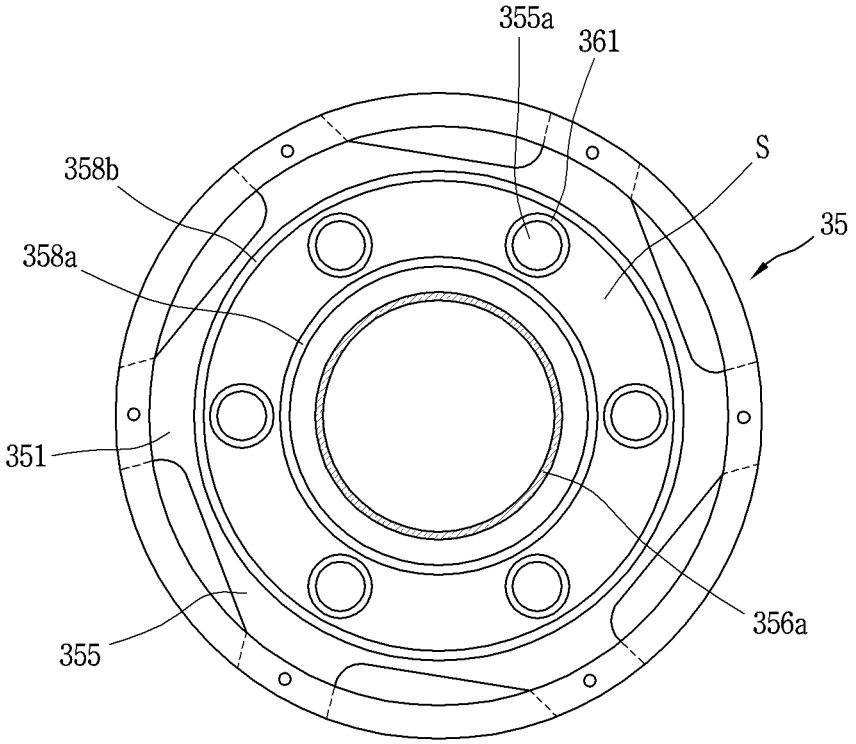
FIG. 7 is a plan view of a back pressure plate as seen from a top in FIG. 5.

FIG. 3 is a vertical cross-sectional view illustrating an embodiment of a mutual rotating scroll compressor according to the present invention, FIG. 4 an enlarged vertical cross-sectional view of a compression unit in FIG. 3, FIGS. 5 and 6 are perspective views illustrating disassembly and assembly of the compression unit in FIG. 3, and FIG. 7 is a plan view of a back pressure plate as seen from a top in FIG. 5.

As illustrated in FIG. 3, in the mutual rotating scroll compressor (hereinafter referred to as a rotating scroll compressor) according to the present embodiment, a motor unit 20 which configures a driving motor and generates a rotational force may be installed in an internal space of a casing 10 forming a discharging space 10*a*, and a compression unit 30 which receives the rotational force from the motor unit 20 to compress refrigerants may be installed under the motor unit 20. Depending on the case, the compression unit 30 may be installed on the motor unit 20.

The casing 10 may include a cylindrical shell 11, and an upper shell 12 and a lower shell 13 which cover an upper end and a lower end of the cylindrical shell 11 to configure a sealing vessel. The lower shell 13 may configure the sealing vessel and may form an oil storage space 10*b*.

A refrigerant suction pipe 15 may pass through a side surface of the cylindrical shell 11, and thus, the cylindrical shell 11 may directly communicate with a suction chamber 30*a* of the compression unit 30. A refrigerant discharging pipe 16 communicating with the discharging space 10*a* of the casing 10 may be installed on the upper shell 12. The refrigerant suction pipe 15 may correspond to a path which guides refrigerants from an evaporator of a freezing cycle to a compression space (in detail, the suction chamber 30*a* of the compression unit) 30 of the casing 10, and the refrigerant discharging pipe 16 may correspond to a path through which compressed refrigerants discharged from the compression unit 30 to the discharging space 10*a* of the casing 10 are discharged to the outside.

A stator 21 configuring the motor unit 20 may be fixedly installed in an upper portion of the cylindrical shell 11, and a rotor 22 which configures the motor unit 20 along with the stator 21 and rotates through interaction with the stator 21 may be rotatably installed in the stator 21.

In the stator 21, a plurality of slots (not referred to by reference numeral) may be provided on an inner circumference surface of the stator 21 along a circumference direction, a coil 25 may be wound around the stator 21, and an oil collection path 211 which is formed through cutting in a D-cut shape may be formed on an outer circumference surface of the stator 21 so that oil passes through a space between the stator 21 and an inner circumference surface of the cylindrical shell 11.

A main frame (hereinafter referred to as a first frame) 31 may be provided under the stator 21 with a certain interval from a lower end of the stator 21. The first frame 31 may configure the compression unit 30 and may be shrinkage fitted or welded to and fixedly coupled to the inner circumference surface of the cylindrical shell 11.

As illustrated in FIGS. 3 and 4, the first frame 31 may include a circular plate part 311 and a ring-shaped wall part 312.

A bearing part 313, into which a first boss part 333 of a rotational shaft 23 to be described below is inserted into and rotatably coupled to, may be provided in a center portion of the circular plate part 311. A first driving bearing 313*a* configuring a first bearing may be installed on an inner circumference surface of the bearing part 313. The first driving bearing 313*a* may include a bush bearing or a ball bearing such as angular.

The ring-shaped wall part 312 may be provided in a cylindrical shape as in FIG. 4. However, the ring-shaped wall part 312 may be provided in plurality, and the plurality of ring-shaped wall parts 312 may be arranged at certain intervals along a circumference direction.

A sub-frame (hereinafter referred to as a second frame) 32 may be installed under the first frame 31 in an axial direction and may be spaced apart from the first frame 31 by a certain interval.

As illustrated in FIGS. 3 and 4, the second frame 32 may be shrinkage fitted or welded to and fixed to the inner circumference surface of the cylindrical shell 11 as in the first frame 31. However, the second frame 32 may be fastened and fixed to the ring-shaped wall part 312 of the first frame 312 by a bolt. On the other hand, the second frame 32 may be fixed to the cylindrical shell 11, and the ring-shaped wall part 312 of the first frame 31 may be fastened to the second frame 31 by a bolt. Therefore, the first frame 31 may be spaced apart from the second frame 32 by a height of the ring-shaped wall part 312, and thus, the first and second frames 31 and 32 may form the compression space 30*a* including a suction chamber.

A hinge groove, which a hinge lug 375 of a bearing housing 37 to be described below is inserted into and rotatably coupled to, may be provided in a center portion of the second frame 32. A hinge groove 321 may be formed as a hinge hole depending on the case, but for convenience, the hinge groove 321 may be referred to as a hinge groove.

As in FIG. 4, a center (hereinafter referred to as a center of a driven bearing, a center of the hinge lug, or a third center) O3 of the hinge groove 321 may be provided on the same axis as a center (hereinafter referred to as a center of a first driving bearing, a center of a second bearing, or a first center) O1 of the bearing part 313. However, in order to increase a sealing force between wraps against a gas repulsion, the center O3 of the hinge groove may be eccentric from the center of the bearing part on a plane. This will be described below.

A driving scroll 33, which is coupled to the rotational shaft 23 to rotate, may be rotatably coupled to the first frame 31. A driven scroll 34, which is engaged with the driving scroll 33 and is rotated by the driving scroll 33, may be rotatably coupled to the second frame 32.

Therefore, the driving scroll 33 and the driven scroll 34 which forms a pair of compression chambers V between the driving scroll 33 and the driven scroll 34 may be provided between the first frame 31 and the second frame 32. Hereinafter, for convenience, the driving scroll may be referred to as a first scroll, and the driven scroll may be referred to as a second scroll. Also, first may be given to a portion relevant to the first scroll, and second may be given to a portion relevant to the second scroll.

As in FIGS. 4 to 6, in the first scroll 33, a first end plate 331 may be provided in an approximately circular plate shape, a first wrap 332 which is engaged with a below-described second wrap 342 to configure a compression chamber V may be provided on a bottom of the first end plate 331, and a first boss part 333 which is rotatably supported by the bearing part 313 of the first frame 31 may be provided in a center of a top of the first end plate 331 to extend in an axial direction. A below-described discharging port 335 may be provided to pass through the first boss part 333, and the discharging port 335 may communicate with a discharging hole 231 which is provided to pass through the inside of the rotational shaft 23.

The first wrap 332 may be provided in an involute shape where a wrap thickness is equal, provided in an algebraic shape where a wrap thickness in a discharging side varies formally, or provided in a shape where a wrap thickness is non-formal.

Moreover, a suction port 334 may be provided in an edge of the first end plate 331, and a discharging port 335 through which compressed refrigerants are discharged may be provided in a center of the first end plate 331. The suction port 334 may be spaced apart from an outer surface of the first wrap 332 adjacent to an outer end of the first wrap 332 in a radius direction and may naturally configure a suction portion. The discharging port 335 may be provided to pass through the first end plate 331 in an axial direction. The discharging port 335 may be variously provided based on a discharging manner, but as described above, the discharging port 335 may be provided to pass through the first boss part 333 and communicate with the discharging hole 231 of the rotational shaft 23 commonly.

A back pressure plate 35 supporting the second scroll 34 may be coupled to an edge bottom of the first end plate 331. Therefore, a space may be formed between the first scroll 33 and the back pressure plate 35, and the second scroll 34 may be rotatably provided in the space.

As in FIGS. 4 and 5, the back pressure plate 35 may include a frame part 351, which is fixed to the first end plate 331 and extends in an axial direction, and a plate part 355 which is included in the frame part 351 and supports a bottom of the second scroll 34.

The frame part 351 may be provided in plurality along a circumference direction, and the plurality of frame parts 351 may be arranged at certain intervals along the circumference direction, and a space between adjacent frame parts 351 may form a suction path 351*a*.

Moreover, upper ends of the frame parts 351 may be connected to one another by one ring-shaped ring 352, and the ring-shaped ring 352 may be fastened to a bottom of the first end plate 331 by a bolt. Therefore, the first scroll 33 may be coupled to the back pressure plate 35 as one body and may rotate together.

As in FIGS. 4 and 5, the plate part 355 may be provided in a circular plate shape, and a below-described bearing housing 37 may be inserted into a center portion of the plate part 355, whereby a bearing lug 356 supported by the bearing housing 37 in the radius direction may be provided. The bearing lug 356 may be provided to protrude by a certain height in a direction from a bottom of the plate part 355 to the second frame 32. However, if a thickness of the plate part 355 is thick, the bearing lug 356 may be provided in a groove or hole form like the bearing part 313.

A second driving bearing 356*a* which supports a portion between the bearing lug 356 and an outer circumference surface of the below-described bearing housing 37 and configures the second bearing may be installed on an inner circumference surface of the bearing lug 356. The second driving bearing 356*a* may include a bush bearing or a ball bearing such as angular like the first driving bearing 313*a*.

Moreover, as in FIGS. 4 and 7, a thrust surface 357 may be provided on a top of the plate part 355 in order for a bottom of a below-described second end plate 341 to be supported in an axial direction. The thrust surface 357 may be provided in a ring shape having a certain height, and an inner thrust surface 357*a* and an outer thrust surface 357*b* may be provided along the radius direction with an interval therebetween.

Moreover, a sealing groove 357*c* may be formed in the inner thrust surface 357*a* to have a certain depth, and another sealing groove 357*c* may be formed in the outer thrust surface 357*b* to have a certain depth. A back pressure chamber sealing member (hereinafter referred to as a sealing member) 358*a* (358*b*) closely adhered to a bottom (a rear surface) of the second end plate 341 may be inserted into each of a plurality of sealing grooves 357*c*. Therefore, a certain space may be formed between the inner thrust surface 357*a* and the outer thrust surface 357*b*, and in detail, between two sealing members 358. The space may communicate with an intermediate pressure chamber Vm of the compression chamber V, and thus, a back pressure chamber S may be provided.

Here, the inner circumference surface of the bearing lug 356 may be inserted to face an outer circumference surface of a housing part 371 of the below-described bearing housing 37, and thus, a gap G between the bearing lug 356 and a below-described second boss part 343 may be reduced. Therefore, an internal diameter D2 of the bearing lug 356 may be reduced, and thus, a diameter D3 of the sealing member 358 may be reduced, thereby decreasing frictional loss between a top of the sealing member 358 and a bottom of the second scroll 34.

Moreover, a pin ring unit 36 may be installed in the back pressure chamber S along the circumference direction. The pin ring unit 36 may include a plurality of rings 361, which are mounted on a top of the plate part 355, and a plurality of pins 362 which are mounted on a bottom of the second end plate 341 corresponding to the plate part 355 and are respectively inserted into the rings 361.

To this end, a plurality of ring grooves 355*a* may be provided at certain intervals along the circumference direction on a top of the plate part 355 so that the rings 361 are respectively inserted into the ring grooves 355*a*. The pin may be coupled to the plate part, but in this case, since the ring should be inserted into a bottom of the second end plate, there can be difficulty in terms of an assembly process. In this manner, if the pin ring unit 36 which is an anti-rotating mechanism is installed in the back pressure chamber S, a space for installing the anti-rotating mechanism is not separately provided, and thus, the compressor can be miniaturized. Also, the anti-rotating mechanism may be installed on a rear surface of the second scroll 34, and thus, the suction path 351 is not plugged, thereby preventing suction loss.

As in FIGS. 4 to 6, in the second scroll 34, the second end plate 341 may be provided in a circular plate shape, a second wrap 342 which is engaged with the first wrap 332 to configure the compression chamber V may be provided on a top of the second end plate 341, and a second boss part 343 which is coupled to the bearing housing 37 and is rotatably coupled to the second frame 32 may be provided in a center of a bottom of the second end plate 341.

The second end plate 341 may be supported by the plate part 355 of the back pressure plate 35 to rotate, and an external diameter of the second end plate 341 may be set less than an internal diameter of the frame part 351 of the back pressure plate 35. Therefore, the second scroll 34 may perform a rotational movement independently from the first scroll 33 and may perform a relative turning movement with respect to the first scroll 33.

Moreover, a back pressure hole 341*a* may be provided in a center portion of the second end plate 341 in an axial direction or an inclined direction to pass through the center portion of the second end plate 341, so that some of refrigerants compressed in the compression chamber V are transferred to the back pressure chamber S. Therefore, refrigerants having an intermediate pressure in an intermediate pressure chamber Vm may flow into the back pressure chamber S, and thus, a pressure of the back pressure chamber S may be maintained as an intermediate pressure.

The second wrap 342 may be provided in an involute shape, an algebraic shape, or a non-formal shape like the first wrap 332. Accordingly, the second wrap 342 may be engaged with the first wrap 332 to configure a pair of compression chambers V1 and V2.

The compression chamber V may be provided between the first end plate 331, the first wrap 332, the second wrap 342, and the second end plate 341, and a as suction chamber Vs, the intermediate pressure chamber Vm, and a discharging chamber Vd may be continuously provided along a direction in which a wrap travels.

Here, the compression chamber V may include a first compression chamber V1, which is provided between an inner surface of the first wrap 332 and an outer surface of the second wrap 342, and a second compression chamber V2 which is provided between an outer surface of the first wrap 332 and an inner surface of the second wrap 342.

Moreover, the second boss part 343 may be provided to protrude by a certain height from a bottom of the second end plate 341, and a center (hereinafter referred to as a center of a driven bearing or a second center) O2 of the second boss part 343 may be provided to be offset by an eccentric distance ε1 with respect to a center (hereinafter referred to as a first center) O1 of the first boss part 333. Therefore, when the first scroll 33 is rotating, the second wrap 342 may contact the first wrap 332, and thus, the second scroll 34 may be provided with a rotational force of the first scroll 33 and may be rotated by the first scroll 33 to form the compression chamber V between the first wrap 332 and the second wrap 342.

Moreover, a bottom of the second boss part 343 may be supported by the below-described bearing housing 37 in an axial direction, and the bearing housing 37 may be supported by the second frame 32 in an axial direction. Therefore, the second scroll 34 may be supported by the bearing housing 37 in an axial direction, and the first scroll 33 may be supported by the second scroll 34 in an axial direction. However, the second scroll 34 may be supported by the bearing housing 37 and the back pressure plate 35 in an axial direction, and the first scroll 33 may be supported by the second scroll 34 in an axial direction.

The hinge groove 321 may be formed in a center top of the second frame 32, and the hinge lug 375 of the bearing housing 37 may be inserted into and rotatably coupled to the hinge groove 321. A center O3 of the hinge groove 321 may be provided to form concentricity with a center (which is the same as a center of the bearing part) O1 of the first driving bearing 313*a* and may be provided so as to be eccentric.

Here, in a state where the second scroll 34 coupled to the bearing housing 37 is not engaged with the first scroll 33, the hinge lug 375 may freely rotate in the hinge groove, between an inner circumference surface of the hinge groove 321 and an outer circumference surface of the hinge lug 375. However, in a state where the second scroll 34 is engaged with the first scroll 33, a rotational center of the first scroll 33 and a rotational center of the second scroll 34 may be located on different axial lines, and thus, the hinge lug 375 cannot freely rotate in the hinge groove 321.

Figure 8:
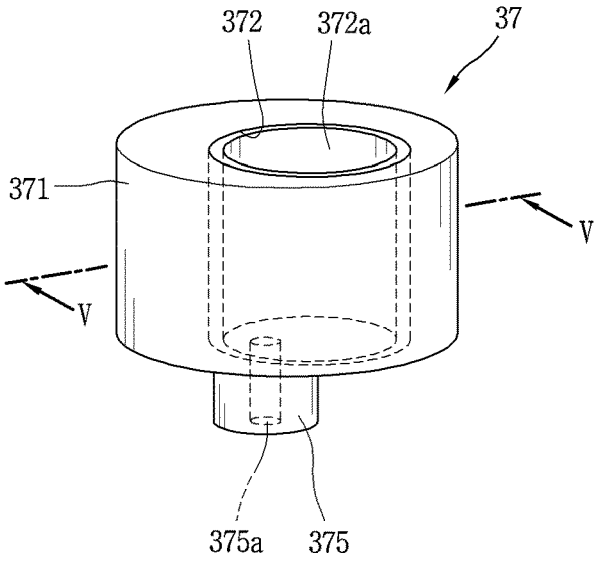
FIG. 8 is an enlarged perspective view of a bearing housing in FIG. 5.
Figure 9:
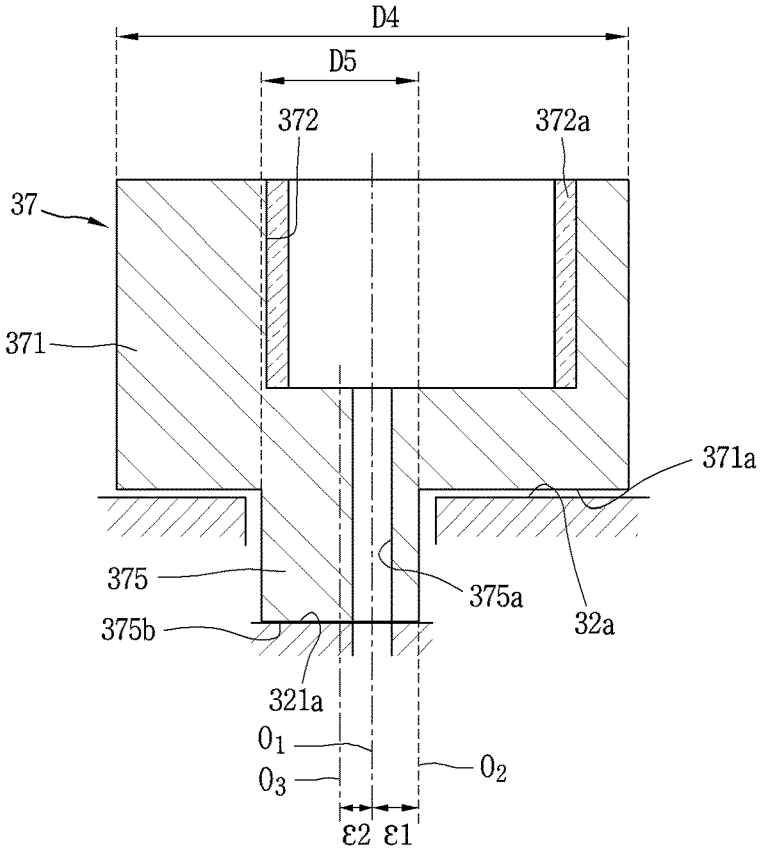
FIG. 9 is a cross-sectional view taken along line V-V illustrating the inside of the bearing housing in FIG. 8.

FIG. 8 is an enlarged perspective view of a bearing housing in FIG. 5, and FIG. 9 is a cross-sectional view taken along line V-V illustrating the inside of the bearing housing in FIG. 8.

As illustrated in the drawings, the bearing housing 37 may include the housing part 371, to which the second scroll 34 is coupled, and the hinge lug 375 coupled to the second frame 35.

A boss accommodation groove 372 into which the second boss part 343 is inserted may be provided on a top of the housing part 371 and may be recessed by a certain depth, and a driven bearing 372*a* which supports an outer circumference surface of the second boss part 343 in the radius direction and configures a third bearing may be provided on an inner circumference surface of the boss accommodation groove 372. The driven bearing 372*a* may be coupled to the outer circumference surface of the second boss part 343.

The boss accommodation groove 372 may be provided so that a center (a second center) O2 thereof is eccentric with respect to a center (a first center) O1 of the housing part 371 on a plane. Therefore, a center O2 of the driven bearing 372*a* may be located at a position which is spaced apart from the center (the first center) O1 of the first driving bearing 313*a* by the eccentric distance ε1.

Moreover, the bearing lug 356 of the back pressure plate 35 may be rotatably inserted onto an outer circumference surface of the housing part 371, and the second driving bearing 356*a* may be provided between the outer circumference surface of the housing part 371 and the inner circumference surface of the bearing lug 356, whereby the back pressure plate (i.e., the first scroll) 35 may be supported by the bearing housing 37 in the radius direction.

The hinge lug 375 may extend and protrude from a bottom of the housing part 371 by a certain height.

As in FIG. 9, an external diameter D5 of the hinge lug 375 may be provided less than an external diameter D4 of the housing part 371. Therefore, the bottom of the housing part 371 may configure a housing-side thrust surface 371*a* in contact with a frame-side thrust surface 32*a* near the hinge groove 321 of the second frame 32 and may configure a thrust bearing surface along with the frame-side thrust surface 32*a*.

However, for convenience, as illustrated in FIG. 9, the hinge groove 321 of the second frame 32 may have a plugged structure, and thus, a bottom 375*b* of the hinge lug 375 may configure a thrust bearing surface on a bottom 321*a* of the hinge groove 321. In this case, the bottom of the housing part 371 may be spaced apart from a top of the second frame 32 by a certain interval, thereby preventing frictional loss from occurring. Accordingly, in this case, an area of the thrust bearing surface is relatively reduced, and thus, frictional loss is reduced in proportion to the reduced area.

Here, in order to prevent an excessive adhesiveness between wraps, the hinge lug 375 may be provided at a position, at which the center O1 of the housing part matches the center O1 of the first driving bearing, at a time when the first wrap 332 contacts the second wrap 342.

Moreover, as in FIG. 9, the hinge lug 375 may be provided so that a center (a third center) O3 thereof is eccentric with respect to the center O1 of the housing part 371 on a plane. Therefore, the third center O3 which is a center of the hinge lug 375 in an axial direction may be eccentric with respect to the second center O2, which is a center of the boss accommodation groove 372 in an axial direction, on a plane. Each of the second center O2 and the third center O3 may be eccentric with respect to the first center O1, which is a center of the first scroll 33 in an axial direction, on a plane.

That is, the hinge lug 375 may be provided at a position which is eccentric with respect to the housing part 371 and is eccentric with respect to the boss accommodation groove 372, and the boss accommodation groove 372 may be eccentric with respect to the housing part 371 in a direction in which the housing part 371 is eccentric.

FIGS. 10A to 11B are schematic diagrams illustrating, as a vector, a relationship of a force acting on each of bearings and a hinge lug in the mutual rotating scroll compressor of FIG. 3.

Figure 10A:
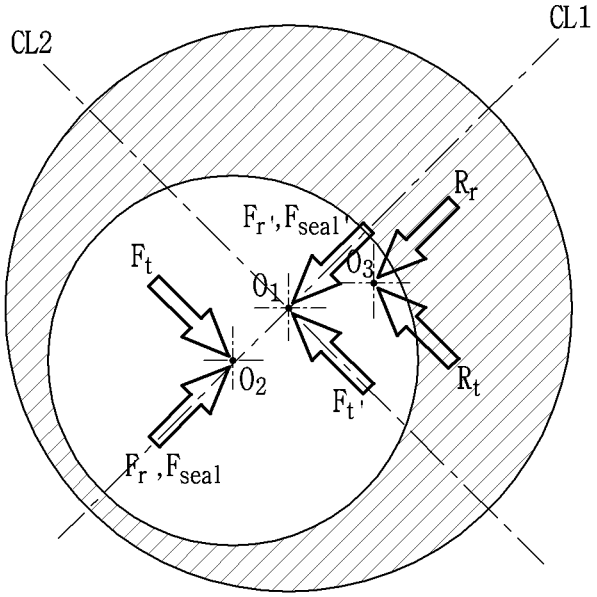
FIGS. 10A to 11B are schematic diagrams illustrating, as a vector, a relationship of a force acting on each of bearings and a hinge lug in the mutual rotating scroll compressor of FIG. 3.

As in FIG. 10A, when it is assumed that a virtual line which connects the center O1 of the housing part and the center O2 of the second boss is referred to as a first center line CL1, and a virtual line which perpendicularly intersects the first center line CL1 and passes through the center O1 of the housing part is referred to as a second center line CL2, the third center O3 may be provided at a position which is spaced apart from each of the first virtual line CL1 and the second virtual line CL2 by a certain distance on the opposite side of the second center O2 with respect to the second virtual line CL2.

Figure 10B:
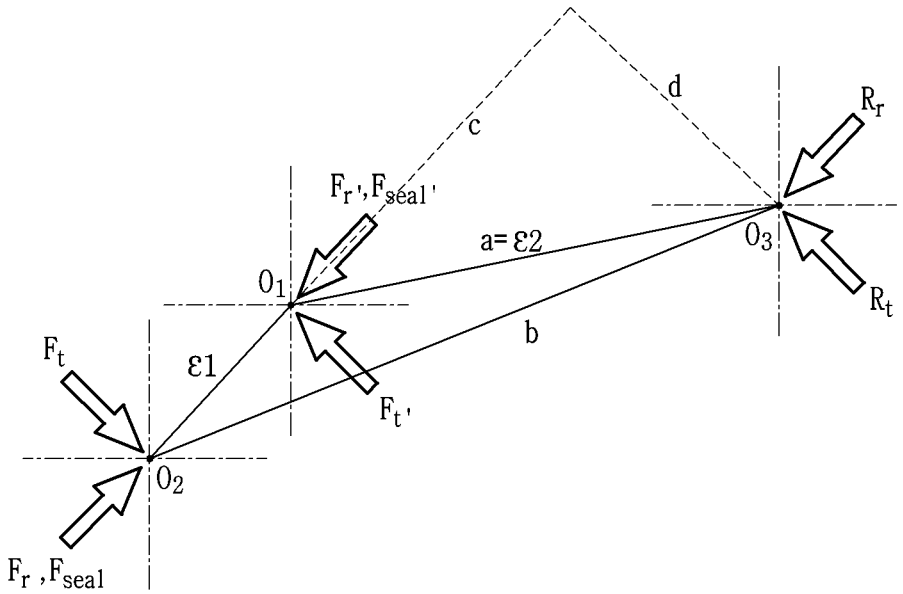

Therefore, as in FIG. 10B, a gas force Fr in a r direction which is a direction in which the second wrap 342 deviates from the first wrap 332 and a t direction gas force Ft which resists a torque of the second scroll may act on the second center O2 which is a center of the boss accommodation groove 372 coupled to the second scroll 34, and a force (i.e., a sealing force Fseal) for offsetting a moment may act in the r direction. Also, a −r direction gas force Fr', a −t direction gas force Ft', and a −r direction sealing force Fseal' which are repulsions against the gas force and the sealing force may act on the first center O1 which is the center of the second driving bearing. With respect to the third center O3 which is a rotational center of the hinge lug, a distance a to the first center O1 may differ from a distance b to the second center O2, and the first center O1 and the second center O2 may be spaced apart from the first virtual line CL1, which connects the first center O1 to the second center O2, by a distance d. Therefore, a moment may be generated in the third center O3 which is the rotational center of the hinge lug 375, and a force which resists the moment may be converted into a sealing force, whereby the first wrap 332 and the second wrap 342 may be closed adhered to each other to seal the compression chamber.

Figure 11A:
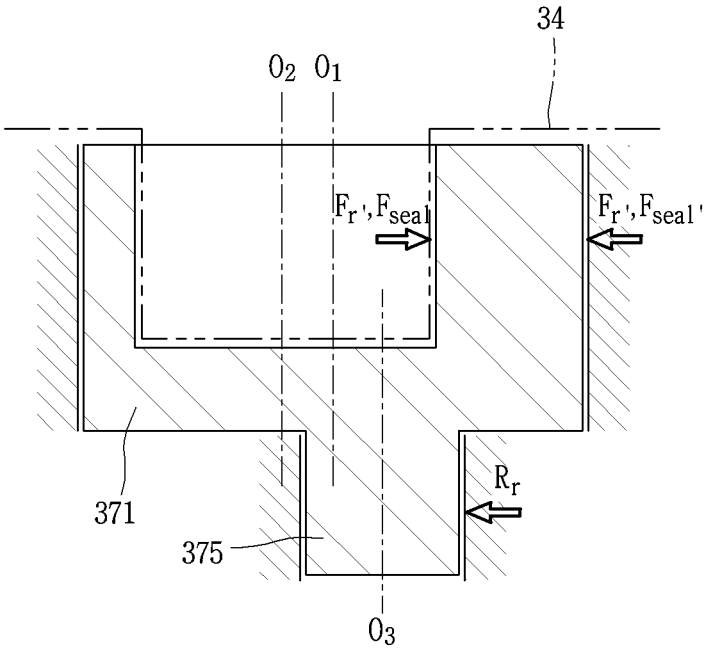
Figure 11B:
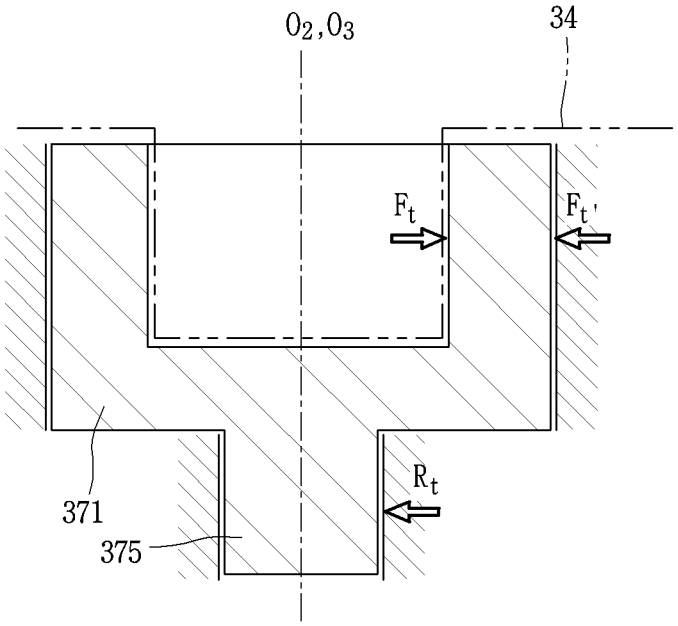

Here, as in FIGS. 11A and 11B, the r direction gas force, the sealing force, and the t direction gas force which are transferred from the first scroll 33 and the second scroll 34 may act on the housing part 371 of the bearing housing 37, and simultaneously, the −r direction gas force, the sealing force, and the −t direction gas force which are repulsions against the r direction gas force and the sealing force may act on the housing part 371 of the bearing housing 37. Therefore, an r direction repulsion Rr and a t direction repulsion Rt may act between the second frame 32 and the hinge groove 321 as repulsions against the gas force and the sealing force. Accordingly, the first scroll 33 and the second scroll 34 may be supported by the bearing housing 37 in the radius direction, and thus, may stably and continuously perform a mutual rotational movement without being keeled.

In the drawings, reference numeral 232 refers to an oil discharging hole, reference numeral 375*a* refers to an oil flow hole, and F refers to an oil collection path.

The rotating scroll compressor according to the present embodiment may operate as follows.

That is, when power is applied to the motor unit 20, a rotation force may be generated in the rotor 22, and thus, the rotor 22 may rotate. When the rotor 22 rotates, the rotational shaft 23 coupled to the rotor 22 may rotate.

Then, the first boss part 333 coupled to the rotational shaft 23 may receive the rotational force to rotate the first scroll 33. At this time, an upper end of the first boss part 333 of the first scroll 33 may be supported by the first driving bearing 313*a* included in the bearing part 313, and simultaneously, a lower end of the bearing lug 356 of the back pressure plate 35 coupled to the first scroll 33 may be supported by the second driving bearing 356*a* provided between the bearing lug 356 and the bearing housing 37. Therefore, each of an upper end and a lower end of the first scroll 33 may be supported in the radius direction with respect to the first wrap 332, thereby preventing the first scroll 33 from being keeled. Accordingly, in the present embodiment, a degree to which the first scroll 33 is inclined with respect to an axial center is minimized, and thus, a gap is prevented from occurring between the first wrap 332 and the second end plate 341 or between the first end plate 331 and the second wrap 342, thereby effectively preventing leakage in an axial direction from the compression chamber.

Therefore, the first scroll 332 may rotate to transfer a rotational force to the second wrap 342 of the second scroll 34 engaged with the first scroll 33, and thus, the second scroll 34 may rotate about the second boss part 343. Therefore, the pair of compression chambers V1 and V2 may be provided between the first wrap 332 and the second wrap 342. At this time, in the second scroll 34, the second boss part 343 may be disposed so as to be eccentric with respect to the first boss part 333 by the bearing housing 37, and simultaneously, the hinge lug 375 which is the center of the hearing housing 37 may be disposed so as to be eccentric with respect to the first boss part 333 and the second boss part 343. Therefore, the eccentric distance ε1 between the first driving bearing 313*a* and the driven bearing 372*a* may vary due to a gas repulsion, and thus, when the compressor is driving, a gas repulsion occurring the second scroll 34 may be converted into the sealing force Fseal, thereby preventing leakage in the radius direction.

Figure 12A:
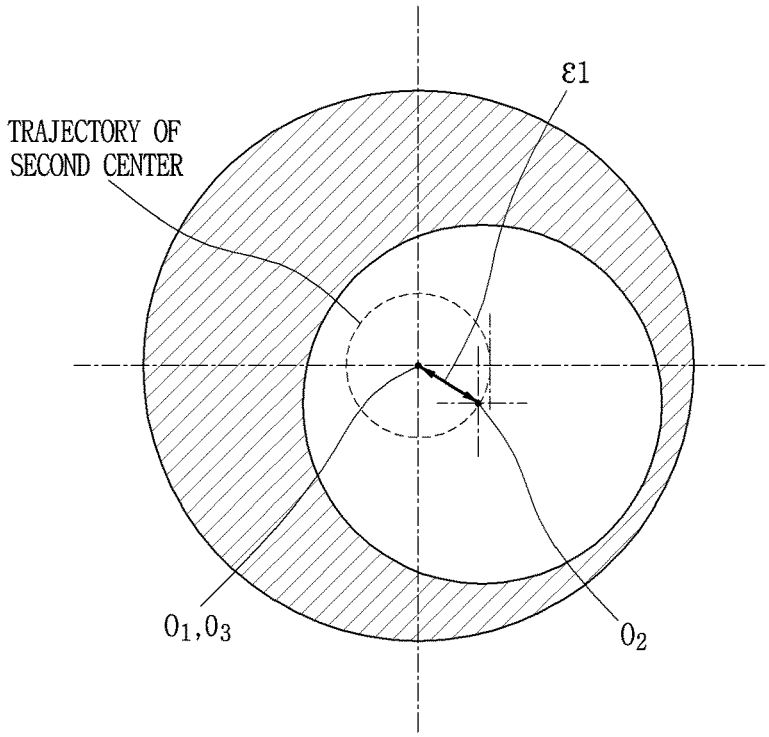
FIGS. 12A and 12B are schematic diagrams for describing a sealing force difference based on a shape of a bearing housing in the mutual rotating scroll compressor of FIG. 3.

Here, as in FIG. 12A, in a case where the center O3 of the hinge groove 321 is provided to form concentricity with the rotational center (hereinafter referred to as a center of the outer circumference surface of the housing part, a center of the housing part, or a center or a first center of the second driving bearing) O1 of the first driving bearing 313*a*, even though the center O1 of the housing part is provided so as to be eccentric with respect to a rotational center (hereinafter referred to as a center or a second center of the second boss part) O2 of a below-described driven bearing, an eccentric distance ε1 of the driven bearing with respect to the center O3 of the hinge groove may be constant when the bearing housing 37 rotates (rotates based on a moment). Therefore, a trajectory of the second center maintains the constant eccentric distance ε1 of the driven bearing which is the same as a turning radius of the second scroll 34 with respect to the first scroll 33, and in a compression stroke, when the first wrap 332 and the second wrap 342 respectively receive the gas force Fr and the gas force Fr' in the r direction deviating from each other, a gap between the first wrap 332 and the second wrap 342 is widened, causing leakage in the radius direction.

Figure 12B:
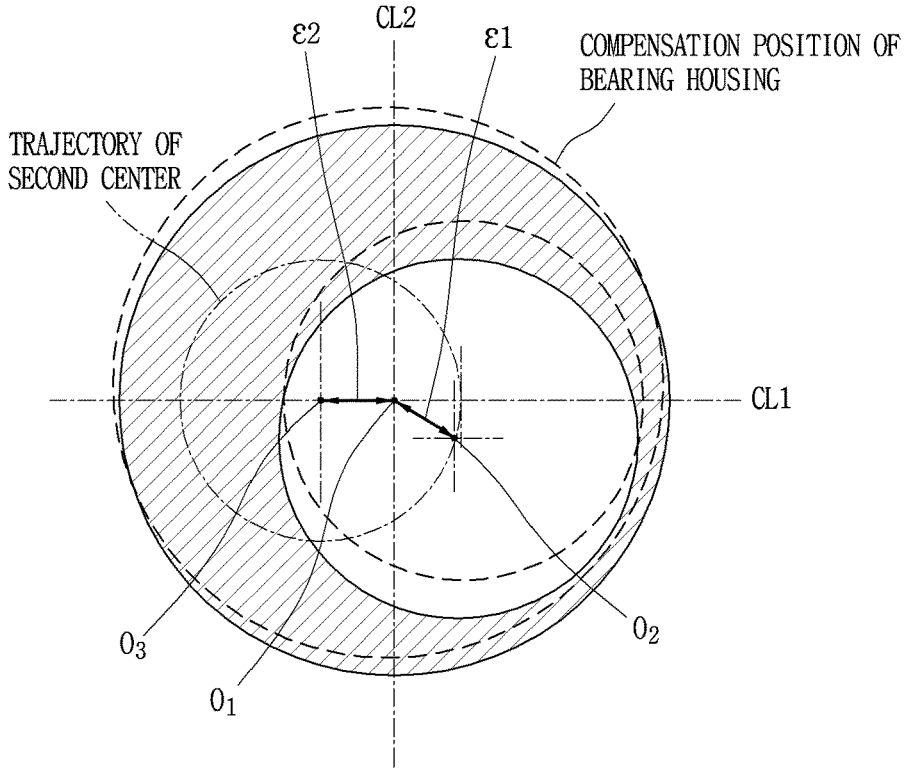

However, as in FIG. 12B, in a case where the center O3 of the hinge groove is spaced apart from the rotational center O1 of the first driving bearing by an eccentric distance ε2 on a plane and is eccentric with respect to the rotational center O1, the rotational center O3 of the below-described bearing housing 37 may be eccentric with respect to the rotational center O1 of the first driving bearing, and thus, when the bearing housing 37 rotates, the eccentric distance ε1 of the driven bearing with respect to the center O3 of the hinge groove may vary. Therefore, in a case where the hinge groove (i.e., a position of the third center O3 with respect to the first center O1 and the second center O2) is disposed at an appropriate position (i.e., a position (i.e., a position at which a sealing force allowing a moment in the third center O3 to become zero is generated) at which a moment for generating a desired sealing force is generated), even when the first wrap 332 and the second wrap 342 respectively receive the gas force Fr and the gas force Fr' in the r direction deviating from each other in a compression stroke, a moment may be converted into a sealing force, and thus, as in a dotted line of the drawing, a position of the bearing housing 37 may be compensated for, a state where the first wrap 332 and the second wrap 342 are closely adhered to each other is maintained, and a leakage of refrigerants in the radius direction is prevented.

Therefore, refrigerants compressed in the first compression chamber V1 and the second compression chamber V2 may be guided to the discharging hole 231 of the rotational shaft 23 through the discharging port 335, and the refrigerants guided to the discharging hole 231 may move to an upper end of the rotational shaft 23, may be discharged to a discharging space 10*a* of the casing 10, and may be discharged to the outside of the compressor through the discharging pipe 16. In this case, the oil discharging hole 232 may be formed in a middle portion of the discharging hole 231, and thus, oil may be separated from the refrigerants moving through the discharging hole 231. The separated oil may be discharged to the discharging space 10*a* of the casing 10 through the oil discharging hole 232 and may be collected to the oil storage space 10*b*, which is a lower space of the casing 10, through an oil collection path F included in each of the first frame 31 and the second frame 32. Such a process may be repeated.

Figure 13:
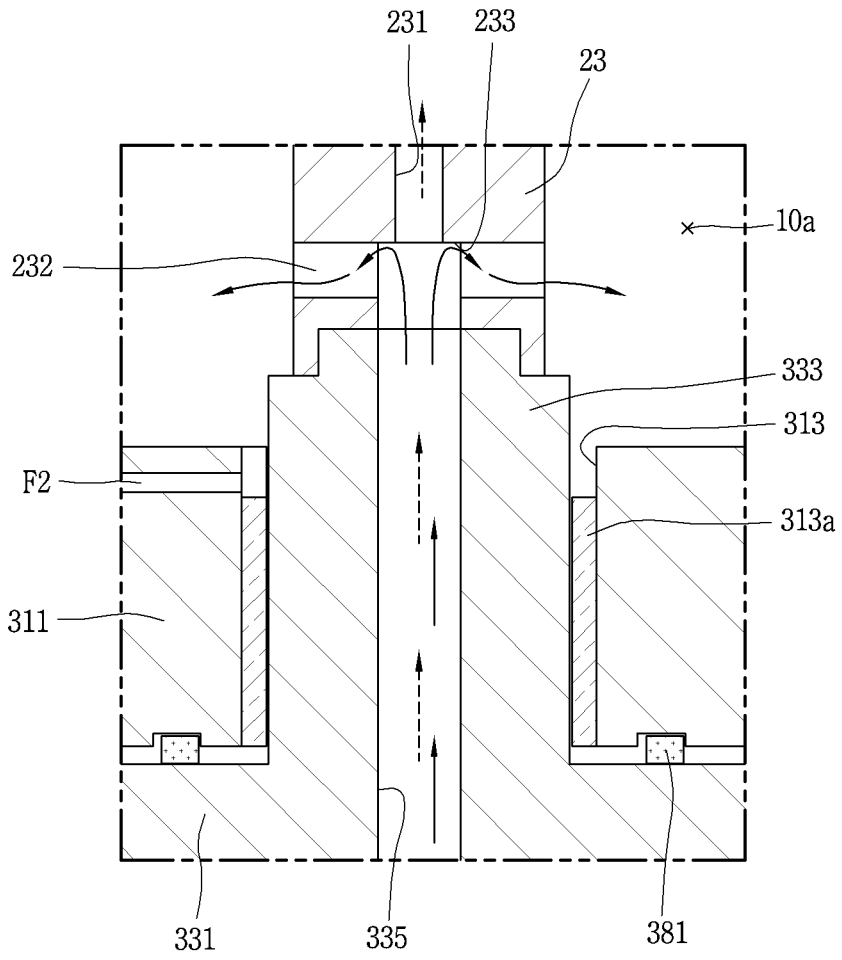
FIG. 13 is an enlarged view for describing an oil separation structure in the mutual rotating scroll compressor of FIG. 3.

Here, an oil separation surface 233 for separating oil from refrigerants moving an upper end of the rotational shaft 23 through the discharging hole 231 may be provided in a middle portion of the discharging hole 231 to have a step height, and in more detail, may be provided on an upper side close to the oil discharging hole 232 as in FIG. 13.

Therefore, refrigerants moving to the upper end through the discharging hole 231 may contact the oil separation surface 233, and thus, heavy oil may be separated from the refrigerants. The separated oil may be discharged to the discharging space through the oil discharging hole 232 by a centrifugal force, but the refrigerants may move to an upper end of the rotational shaft 23 through the discharging hole 231.

In the above-described mutual rotating scroll compressor according to the present invention, a separate oil pump may be applied for supplying oil to a sliding part, but as a high pressure is formed in an internal space of the casing, oil may be fed by using a pressure difference.

Figure 14:
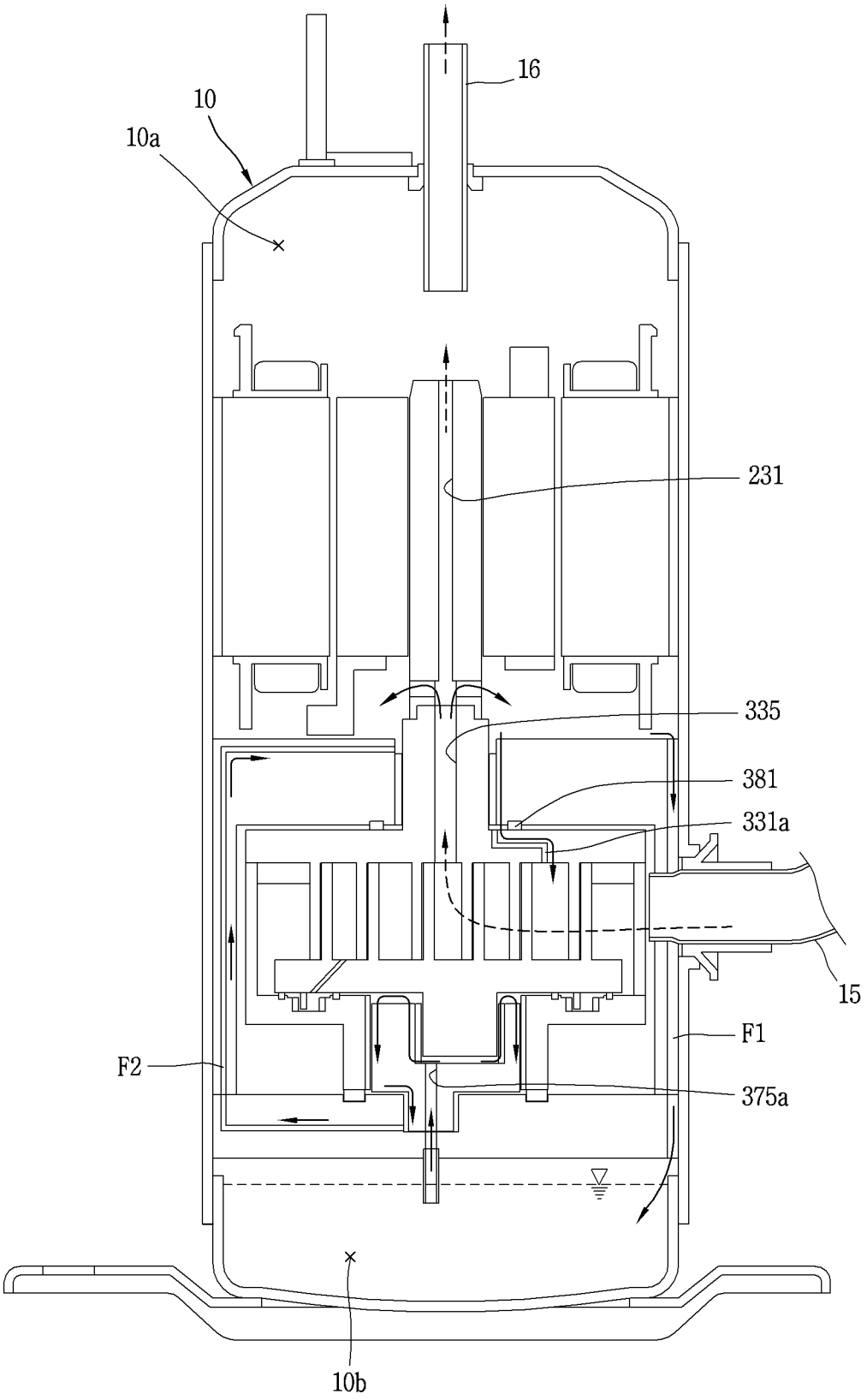
FIG. 14 is a schematic view for describing a fueling process in the mutual rotating scroll compressor of FIG. 3.

For example, as in FIG. 14, an upper separation member 381 may be installed between the bottom of the first frame 31 and the top (the rear surface) of the first scroll 33, and a lower separation member 382 may be installed between the bearing lug 356 of the back pressure plate 35 and the top of the second frame 32. Accordingly, the compression space 30*a* of the compression unit 30 may be separated from the internal spaces 10*a* and 10*b* of the casing 10.

Here, the upper separation member 381 and the lower separation member 382 may each be provided in a ring shape. The upper separation member 381 may be fixedly coupled to a top of the first end plate 331, and the lower separation member 382 may be fixedly coupled to the top of the second frame 32 so as to be sealed to a bottom of the bearing lug 356.

Moreover, an oil flow path may be formed between the upper separation member 381 and the lower separation member 382, and thus, oil filled into the oil storage space 10*b* of the casing 10 may be provided to the first driving bearing 313*a*, the second driving bearing 356*a*, and the driven bearing 372*a*.

Here, the oil flow path may pass through the hinge lug 375 of the bearing housing 37 and may include a gap between each of the bearings 372*a*, 356*a*, and 313*a* and a member supported by a corresponding bearing and flow paths F2 which respectively pass through the first frame 31 and the second frame 32.

That is, oil stored in the oil storage space 10*b* may flow into the boss accommodation groove 372 through the oil flow hole 375*a* passing through the hinge lug 375 of the bearing housing 37, and the oil may lubricate the driven bearing 372*a*. Some of the oil may lubricate a thrust surface between the second scroll 34 and the back pressure plate 35 and may move toward the compression chamber V, and the other oil may move toward the second driving bearing 356*a*.

Moreover, oil which has lubricated the second driving bearing 356*a* may pass through the oil flow paths F2 of the first frame 31 and the second frame 32 through the outer circumference surface of the hinge lug 375 and the inner circumference surface of the hinge groove 321 and may lubricate the first driving bearing 313*a*. The oil may be provided to the intermediate pressure chamber Vm or the suction chamber Vs through an oil feed hole 331*a* included in the first scroll 33.

In this case, a pressure of the oil storage space 10*b* is a high pressure, and the compression space 30*a* may have an intermediate pressure. Therefore, the oil stored in the oil storage space 10*b* may move along the oil flow path F according to a pressure difference and may be provided to a sliding part of each of the hinge groove, the inner circumference surface of the first driving bearing, the inner circumference surface of the second driving bearing, and the inner circumference surface of the driven bearing.

Subsequently, oil which is discharged through the discharging port 335 along with refrigerants may be separated from the refrigerants by a centrifugal force and the oil separation surface 233 while passing through the discharging port 335, and the refrigerants may be discharged to the discharging space 10*a* of the casing 10 through the discharging hole 231. On the other hand, the oil may be previously discharged to an internal space (a lower space of the motor unit) of the casing 10 through the oil discharging hole 232 and may be collected to the oil storage space 10*b* of the casing 10 through the oil collection path F1. Such a process may be repeated.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A mutual rotating scroll compressor comprising:

a casing;

a driving motor located within the casing;

a first frame supported by the casing;

a second frame attached to the first frame, the first frame and the second frame together forming a compression space between the first frame and the second frame;

a first scroll coupled to the driving motor, the first scroll being rotatably supported by the first frame to rotate within the compression space;

a second scroll engaged with the first scroll to rotate with the first scroll within the compression space, the first scroll and the second scroll forming a compression chamber within the compression space; and a bearing housing supporting the second scroll, the bearing housing including:

a housing part, the housing part including a boss accommodation part to which the second scroll is rotatably coupled; and a hinge lug extending from the housing part, the hinge lug being movably coupled to the second frame, wherein an axial center of the first scroll defines a first center, wherein an axial center of the boss accommodation part defines a second center, wherein an axial center of the hinge lug defines a third center, wherein the third center of the hinge lug is eccentric with respect to the second center of the boss accommodation part, and wherein the second center of the boss accommodation part and the third center of the hinge lug are each eccentric with respect to the first center of the first scroll.

2. The mutual rotating scroll compressor of claim 1, wherein a line connecting the first center of the first scroll to the second center of the boss accommodation part defines a first virtual line, wherein a line perpendicularly intersecting the first virtual line and passing through the first center of the first scroll defines a second virtual line, wherein the third center of the hinge lug is provided at a position which is spaced apart from each of the first virtual line and the second virtual line by a certain distance, and wherein the second center of the boss accommodation part and the third center of the hinge lug are provided at positions on opposite sides of the second virtual line.

3. The mutual rotating scroll compressor of claim 2, wherein a distance between the third center of the hinge lug and the first center of the first scroll defines a first distance, wherein a distance between the third center of the hinge lug and the second center of the boss accommodation part defines a second distance, and wherein the first distance is shorter than the second distance.

4. The mutual rotating scroll compressor of claim 3, wherein an axial center of the housing part is coincident with the first center of the first scroll.

5. The mutual rotating scroll compressor of claim 1, further comprising a back pressure plate coupled to the first scroll, the back pressure plate being rotatable together with the first scroll, the back pressure plate supporting a rear surface of the second scroll, the back pressure plate having a first end coupled to the first scroll as one body, and the back pressure plate further having a second end rotatably coupled to the bearing housing, wherein a first end of the first scroll in an axial direction is supported in a radius direction by the first frame, and wherein a second end of the first scroll in the axial direction is supported in the radius direction by the bearing housing via the back pressure plate.

6. The mutual rotating scroll compressor of claim 5, wherein the second end the back pressure plate comprises a bearing lug, and wherein the bearing lug is inserted onto and rotatably coupled to an outer circumferential surface of the housing part of the bearing housing.

7. The mutual rotating scroll compressor of claim 5, wherein the back pressure plate further comprises:

a plurality of frame parts coupled to the first scroll; and a plate part coupled to the plurality of frame parts, the plate part being located at the rear surface of the second scroll, and wherein the mutual rotating scroll compressor further comprises an anti-rotating member provided between the plate part and the second scroll for preventing rotation of the second scroll with respect to the plate part.

8. The mutual rotating scroll compressor of claim 7, wherein a back pressure chamber is provided between the second scroll and the back pressure plate, the back pressure chamber supporting the second scroll in a direction toward the first scroll, and wherein the anti-rotating member is located in the back pressure chamber.

9. The mutual rotating scroll compressor of claim 8, further comprising:

a first sealing member located at a first surface of the plate part that is adjacent to the rear surface of the second scroll; and a second sealing member located at the first surface of the plate part, the second sealing member being spaced radially outwardly of the first sealing member, wherein the back pressure chamber is provided between the first sealing member and the second sealing member, and wherein the anti-rotating member is located in the back pressure chamber between the first sealing member and the second sealing member.

10. The mutual rotating scroll compressor of claim 1, further comprising:

a boss part configured to receive a rotational force of the driving motor;

an oil discharging path provided in the boss part, the oil discharging path being configured to communicate with the compression chamber to guide compressed refrigerant to an internal space of the casing; and an oil discharging hole provided at an intermediate portion of the oil discharging path, the oil discharging hole passing through the boss part from an inner circumferential surface of the boss part that defines the oil discharging path to an outer circumferential surface of the boss part, wherein an outer end of the oil discharging hole is located between the first frame and the driving motor.

11. The mutual rotating scroll compressor of claim 10, further comprising a stepped surface provided at the intermediate portion of the oil discharging path, the stepped surface being configured to separate oil from the refrigerant.

12. The mutual rotating scroll compressor of claim 11, wherein the boss part comprises:

a first boss part provided on the first scroll, the first boss part being supported by the first frame;

a rotational shaft having a first end coupled to a rotor of the driving motor and a second end coupled to the first boss part;

a discharging port provided in the first boss part, the discharging port sequentially passing from the compression chamber to an end of the first boss part; and a discharging hole passing through the rotational shaft between the first and second ends of the rotational shaft, the discharging hole communicating with the discharging port, and wherein the oil discharging hole and the stepped surface are provided in either the first boss part or the rotational shaft.

13. The mutual rotating scroll compressor of claim 1, wherein the first frame is sealingly coupled to an inner circumferential surface of the casing to form a first internal space between the casing and an upper side of the first frame, wherein the second frame is sealingly coupled to the inner circumferential surface of the casing to form a second internal space between the casing and a lower side of the second frame, wherein the first internal space communicates with the second internal space, wherein the compression space is separated from the first internal space and the second internal space, and further comprising:

a suction pipe passing through the casing and into the compression space, a discharging pipe passing through the casing and into the first internal space, and an oil feed path provided in each of the first frame and the second frame, the oil feed path being configured to guide oil from the second internal space to sliding parts of the first frame and the second frame.

14. The mutual rotating scroll compressor of claim 13, further comprising:

a first sealing member provided at the first frame to separate the compression space from the first internal space; and a second sealing member provided at the second frame to separate the compression space from the second internal space.

15. A mutual rotating scroll compressor comprising:

a casing;

a first frame supported by the casing;

a bearing part provided in the first frame;

a second frame supported by the casing and spaced from the first frame;

a hinge groove provided in the second frame, the hinge groove being located eccentrically with respect to the bearing part;

a first scroll rotatably supported by the first frame, the first scroll including a first boss part rotatably inserted into the bearing part of the first frame;

a second scroll engaged with the first scroll to rotate with the first scroll, the second scroll including a second boss part which is located eccentrically with respect to the first boss part of the first scroll;

a bearing housing supporting the second scroll, the bearing housing including:

a boss accommodation part into which the second boss part of the second scroll is rotatably inserted; and a hinge lug movably coupled to the hinge groove of the second frame;

a back pressure plate, the back pressure plate having a first end coupled to the first scroll, the back pressure plate further having a second end including a bearing lug rotatably inserted onto an outer circumferential surface to the bearing housing;

a first bearing provided between the bearing part of the first frame and the first boss part of the first scroll;

a second bearing provided between an inner circumferential surface of the back pressure plate and an outer circumferential surface of the bearing housing; and a third bearing provided between the second boss part of the second scroll and an inner circumferential surface of the boss accommodation part of the bearing housing.

16. The mutual rotating scroll compressor of claim 15, wherein an axial center of the third bearing is located at an eccentric distance from an axial center of the first bearing, and wherein the eccentric distance varies as the bearing housing rotates about the hinge lug.

17. The mutual rotating scroll compressor of claim 16, wherein the first scroll includes a first wrap and the second scroll includes a second wrap, the compression chamber being formed between the first wrap and the second wrap, and wherein the axial center of the first bearing and an axial center of the second bearing are coincident when the first wrap contacts the second wrap.

18. A mutual rotating scroll compressor comprising:

a driving scroll;

a driven scroll driven by the driving scroll to rotate together with the driving scroll;

a first member to which the driven scroll is rotatably coupled, the first member being eccentric with respect to a rotational center of the driven scroll, wherein the first member is configured so that a turning radius of the driven scroll with respect to the driving scroll varies; and a second member coupled to the driving scroll, the second member providing a back pressure chamber at a rear surface of the driven scroll, the second member being rotatably inserted onto an outer circumferential surface of the first member.

19. The mutual rotating scroll compressor of claim 18, wherein the first member comprises a hinge lug, the hinge lug being eccentric with respect to a rotational shaft of the driving scroll.

* * * * *